US005878464A

United States Patent [19]

White

[11] Patent Number: 5,878,464

[45] Date of Patent: Mar. 9, 1999

[54] APPARATUS AND METHOD FOR CONVERTING CONTINUOUS TOW FIBERS INTO A STAPLE LENGTH

[76] Inventor: Homer S. White, 3314 Pickett Rd., Durham, N.C. 27705

[21] Appl. No.: 927,741

[22] Filed: Sep. 11, 1997

Related U.S. Application Data

[60] Provisional application No. 60/015,509 Apr. 16, 1996.

[51] Int. Cl.[6] ..... D01G 1/04

[52] U.S. Cl. ..... 19/0.37; 19/0.39; 19/0.56; 19/0.6; 83/913; 219/121.67; 219/121.72

[58] Field of Search ..... 19/0.3, 0.35, 0.37, 19/0.46, 0.48, 0.51, 0.56, 0.58, 0.6, 0.62, 0.64; 83/913; 219/121.18, 121.67, 121.72, 121.39; 65/483, 507, 508, 509

[56] References Cited

U.S. PATENT DOCUMENTS

| | | | |
|---|---|---|---|
| 2,431,048 | 9/1947 | Smith | 19/1 |
| 2,569,957 | 10/1951 | Schneider | 19/1 |
| 3,757,077 | 9/1973 | Sinclari et al. | 219/121 L |
| 5,011,282 | 4/1991 | Ream et al. | 356/153 |
| 5,400,476 | 3/1995 | White | 19/239 |

OTHER PUBLICATIONS

Title, copyright notice pages; pp. 286–287 "lasers in industry", edited by S.S. Charschan, Member of Research Staff, Western Electric.

Title, copyright page; page 46 "Man–Made Fiber And Textile Dictonary" by Celanese Corporation.

Updated cover page; pp. 3–10 and technical characteristics page from trade brochure describing TT12 Converter made by R. Schlumberger & Cie of France.

*Primary Examiner*—Michael A. Neas
*Assistant Examiner*—Larry D. Worrell, Jr.

[57] ABSTRACT

An apparatus and method enables a synthetic fiber tow of indeterminate length passed through a break drawframe to be converted to relatively short spinnable staple length fibers in the form of sliver. During passing through the drawframe, a concentrated beam of energy, illustrated as being a laser beam is swept across the tow by a rotating mirror and in the course of doing so, effectively cuts the tow fibers where struck by the laser beam. In one embodiment the laser beam stays on while sweeping across the width of the tow and then repeats that cycle in a succeeding section of tow. In another embodiment, the laser beam is energized and deenergized as it transverses across one section of tow and in the next succeeding section of tow the laser beam is actuated in a different time cycle.

13 Claims, 4 Drawing Sheets

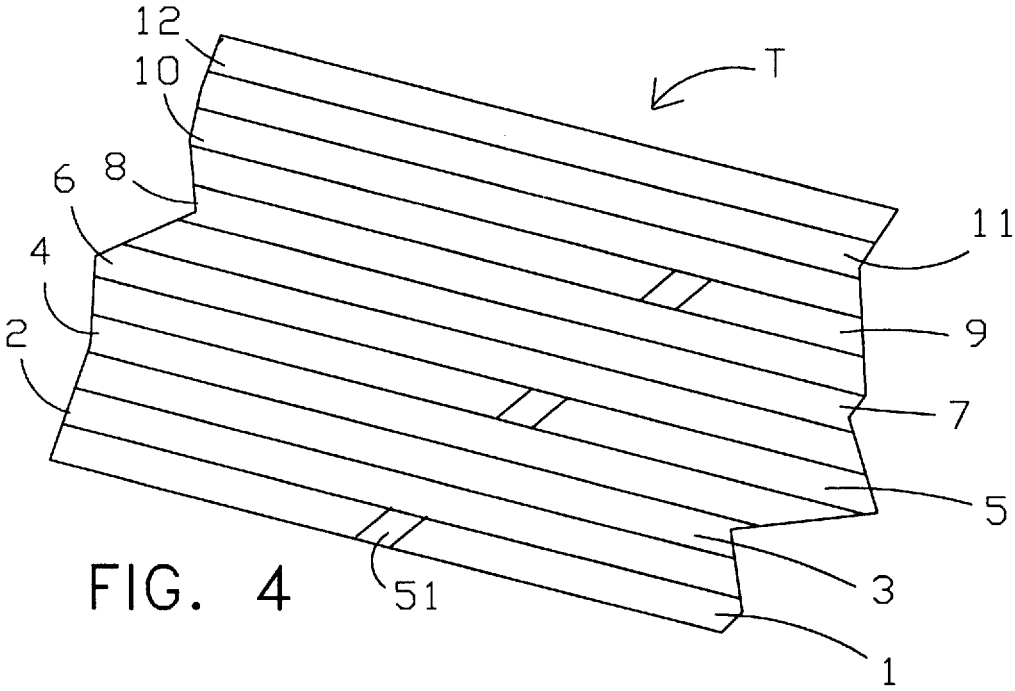
FIG. 4
| | | | | | | | | | | | |
|---|---|---|---|---|---|---|---|---|---|---|---|
| SWEEP 1 | 1 | | | 5 | | | 9 | | | | |
| SWEEP 2 | | 2 | | | 6 | | | 10 | | | |
| SWEEP 3 | | | 3 | | | 7 | | | 11 | | |
| SWEEP 4 | | | | 4 | | | 8 | | | 12 | |
FIG. 5
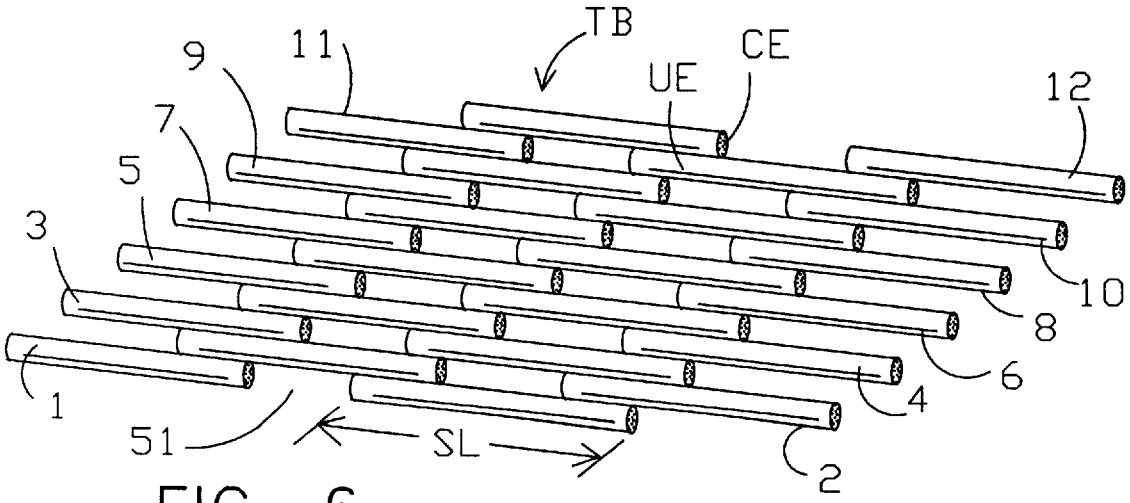
FIG. 6

APPARATUS AND METHOD FOR CONVERTING CONTINUOUS TOW FIBERS INTO A STAPLE LENGTH

RELATION TO COPENDING PROVISIONAL APPLICATION

This application is based on and claims priority of applicant's previously filed Provisional Application No. 60-015509 filed Apr. 16, 1996 entitled "Laser Assisted Break Drawing Of Textile Fibers Apparatus and Method" and PCT application No. PCT/US No. 97/06299 filed Apr. 15, 1997 entitled "Apparatus And Method For Converting Continuous Tow Fibers Into Staple Length Fibers".

FIELD OF INVENTION

The invention relates to an apparatus and method for converting in a single operation a continuous textile fiber tow of indeterminate length into a sliver comprised of spinnable fibers of a relatively short and uniform staple length.

BACKGROUND OF THE INVENTION

Various kinds of textile manufacture require the availability of fiber of uniform and relatively short staple length. Certain natural fibers such as cotton may inherently meet this requirement. Synthetic fibers, such as acrylic, polypropylene, nylon, polyester and the like, in the form of a tow of indeterminate length, typically require some type of processing in order to convert the tow to fibers of uniform staple length. The tow may have several hundred thousand individual fibers. In many cases, the tow is chopped into staple length fibers so that yarn can be spun. However, after being chopped, the uniform nature of the tow is destroyed and it is necessary to use a carding process to restore uniformity to the material.

As an alternative to chopping the tow, break drawing has been used to convert certain synthetic textile fibers in the form of continuous tow to a sliver of staple length fibers suitable for spinning into yarn. Break drawing is the practice of rapidly feeding the tow through two relatively closely spaced sequential pairs of rollers the second of which operates at a higher speed than the first so as to assert sufficient tension to break the fibers. For example, the output rollers may operate at a speed one and one-half to four times the speed of the input rollers, and the tow may be travelling at a speed of several yards per second. The rollers are conventionally spaced apart by a distance, e.g. three inches, just over the desired staple length, e.g. two and one-half inches. Rollers spacing as described herein refers to the distance between the nip points of the rollers. However, break drawing can be only used with synthetic fiber material which breaks under tension rather than simply stretching. Break drawing is also of limited use with synthetic fibers which require considerable force before breaking since such fibers may slip on either one or both of the input or output draw rolls, resulting in uneven staple length or undesired short-term variations in weight per unit length of the sliver so produced. As a result, only a few synthetic fibers such as acrylic can be processed using break drawing, while the majority of the synthetic fibers such as polyester, polypropylene, and nylon are either too elastic or are too strong for the break draw process. Even acrylic fiber tends to break unevenly and a further process of break drawing, sometimes called rebreak drawing, is frequently required to get the fibers to optimum staple length.

As a further alternative way of converting a synthetic fiber tow of indeterminate length into staple fibers of uniform length, it has been known to cut the fibers by passing the tow between a cutting roller and an anvil, the length of the staple fiber being determined by the pitch of the roller. One such system is sold as the TT12 Converter by N. Schlumberger and Cie of France. The cutting roller system inherently requires that the cutting roller be replaced when worn or when the staple length is to be changed.

Thus, it can be seen that there is a need for an apparatus and method which enable a wide range of types of continuous filament synthetic textile tow of indeterminate length to be converted into a sliver comprised of spinnable fibers of relatively short and uniform staple length and which eliminate the need for carding the short staple length fibers produced by such apparatus and method. More specifically, the invention recognizes a need for an easily controlled apparatus and method which incorporates both tensioning and localized heating of the fibers during break drawing so as to be able to produce from a tow of synthetic fibers of indeterminate length staple fibers of relatively short and staple length but without requiring the level of mechanical stress required to break the fibers at ambient temperature.

Since the illustrated and later described embodiments of the invention utilize a laser beam which is swept across the tow material in a transverse direction as the tow is drawn in a machine direction such that the interaction of the beam wavelength with the tow material causes localized heating of small fiber groups, mention is made of the prior art practice of using a laser for cutting cloth. Recognition is also given to the laser providing a unique source of coherent radiation capable of focusing all of the laser's output energy into an extremely small spot and thus achieving a high level of power density. The practice of sweeping a laser beam over a workpiece by use of a mirror for the purpose of using the interaction between the laser beam and the workpiece material to create localized heat and thereby modify the workpiece is also recognized. In such a system known as a Primary Pattern Generator (PPG) and described at pages 286–287 in the book *"Lasers in Industry"*(1972) edited by S. S. Charschaw, the workpiece is positioned under control of a computer which also controls the on-off status of the laser. However, so far as applicant is aware, it has not heretofore been known to use a mirror reflected laser beam to heat selected portions of a synthetic fiber tow of indeterminate length during its passage through a break drawframe and in a manner which results in the creation of staple fibers of substantially uniform and relatively short length.

With the foregoing in mind, the primary object of the invention is to provide an apparatus and method based on using known break drawing apparatus and the break drawing technique in conjunction with a concentrated source of heat, preferably produced by a laser beam, to convert continuous synthetic fiber tow to staple fibers of relatively short and uniform length.

Other objects will appear as the description proceeds.

SUMMARY OF THE INVENTION

The apparatus and method of the invention enable textile fibers in the form of continuous tow to be converted into spinnable staple length fibers in the form of sliver without the need of a carding operation. A conventional break drawframe is used to put tension on the fibers which make up the tow. Instead of using the level of mechanical stress required to break the fibers into staple length, a concentrated beam of energy from a suitable device such as a laser and reflected by a moveable mirror is used to create heat in the fibers and thereby assist in the breaking of the fibers. A more uniform staple length than that produced by a conventional drawframe is achieved. Certain synthetic fibers which do not process satisfactorily in a conventional break drawframe are now able to be processed. Unlike in the practice in which fiber is chopped to achieve a desired staple length, the normal carding process can be eliminated.

In the method of the first embodiment, the laser is operated continuously during each sweep of its beam across the fiber tow. This method results in a series of breaks each of which is on a diagonal to the tow because of the motion of the fibers through the drawbox during each sweep of the laser beam. This method has the advantage that all fibers are guaranteed to be cut but introduces the possibility that the resulting broken sliver may separate because of the lack of support of the fibers.

In order to keep the sliver intact, the laser in the method of a second embodiment is pulsed on and off during each sweep of the laser across the tow so that only a small portion of the fibers in the tow are broken during any one sweep. The pulsing of the laser is controlled so that the cut areas are shifted laterally on each sequential sweep of the laser beam and so that after several very rapid and successive sweeps of the laser beam, all the fibers in a relatively short length of the tow will have been cut to the desired staple length. This results in a well controlled sliver which is unlikely to separate because the staple ends of the fibers are supported by fibers nearby which are not cut at that point.

In a third embodiment, the laser beam is reflected onto the tow passing through the breakframe by means of a multi-faced, rotating mirror.

In all embodiments as described by way of example, the laser beam always travels in the same direction and in a linear path.

BRIEF DESCRIPTION OF THE DRAWINGS

FIG. 4 is a diagram illustrating for reference how a selected portion of tow being processed as viewed from above can be thought of as consisting, for purposes of discussion, of twelve separate longitudinal portions.

FIG. 5 is a chart for illustration of how the twelve portions seen in FIG. 4 can be cut at different laterally and longitudinally spaced locations on each of four sweeps, being used for illustration, of the laser beam by the apparatus and method of FIG. 3.

FIG. 6 is a greatly enlarged and somewhat schematic view of the twelve longitudinal portions of FIG. 4 arranged after being processed according to the method of FIG. 3.

DETAILED DESCRIPTION OF THE INVENTION

Figure 1:
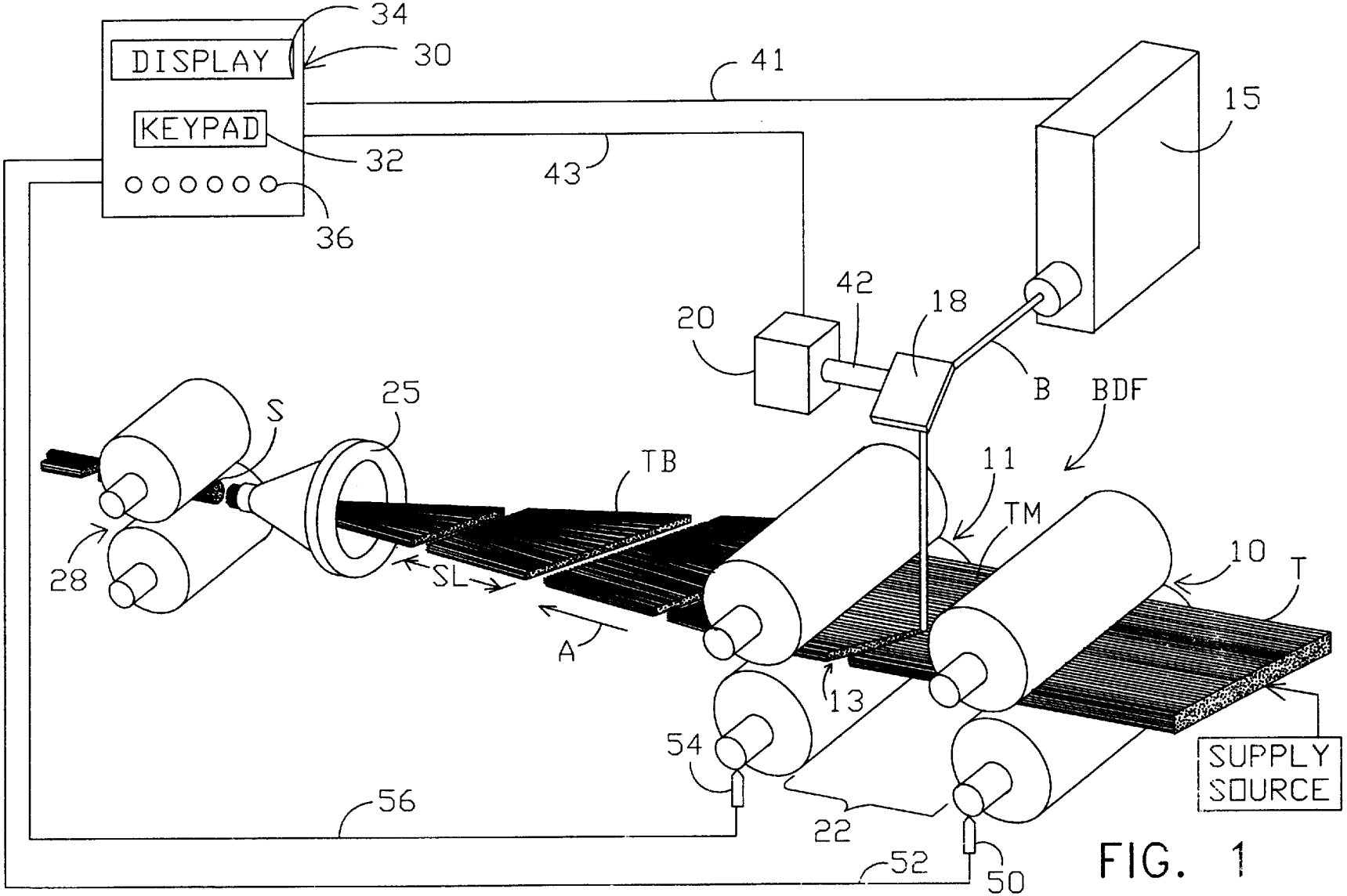
FIG. 1 schematically illustrates the invention apparatus in an operative state according to a first embodiment which employs a single-faced mirror.

The first embodiment of the apparatus and method of the invention is shown in an operative state in FIG. 1 in which a tow T is introduced from a supply, not shown but schematically represented in FIG. 1, into infeed rollers 10 and proceeds to draw rollers 11 between which the tow is tensioned. While not shown, it is contemplated that the tow T can be passed through guides if necessary to maintain good lateral control of the tow. The rollers 10, 11 form part of a break drawframe BPF including a suitable roller drive mechanism, not shown.

In contrast to the conventional break drawframe in which the pairs of rollers 10, 11 are typically spaced apart just over one staple length, the rollers of the break drawframe BDF of the invention are spaced apart by a distance, e.g. five inches, which is slightly less than twice the desired staple length. A laser 15 provides a concentrated beam B of electromagnetic radiation which strikes the reflecting face of a mirror 18. Mirror 18 is controlled by a motor positioner 20 and causes the energy beam B to both sweep across and to contact the tow material, referred to in the drawings as TM, approximately midway between infeed roller pair 10 and draw roller pair 11 along cut-line 13. This interaction between the laser beam wavelength and the fiber material in the tow TM causes the fiber contacted by the beam B to heat very rapidly and while under the influence of such localized heating and the tension asserted by the infeed roller pair 10, 11 to break and therefore effectively be cut into the desired staple length. Dye or other fiber treatment can be used to enhance the absorption of the particular laser wavelength and resultant heating of the particular fiber. While the tow material TM is traveling through the draw zone 22, the energy beam B is swept across the tow material TM in a direction transverse to the motion of the tow as indicated by the arrow A. Motor positioner 20 can be operated in coordination with energizing and deenergizing laser 15 under the control of computer 30 either in the mode of mirror 18 rotating continuously or reciprocating as desired and as best fits the operating conditions. The pair of draw rollers 11 is driven at a higher rate of speed than that of the first pair of infeed rollers 10 by a drive mechanism, not shown, so that the combined action of the mechanical tension asserted by the rollers and the heat effect of the energy beam B serves to break the fibers into staple length portions SL. In addition, the relatively higher speed of draw rollers 11 compared to the speed of infeed rollers 10 caused the portion of tow TM ahead of cut line 13 to spread apart from the portion of tow TM trailing cut line 13.

The resulting staple length fiber SL moving in the direction A is then condensed into a sliver S by being drawn through the trumpet 25 by a pair of rollers 28. Rollers 28 are typically driven by the same mechanical drive (not shown) used to drive rollers 10 and 11. The sliver S comprises a bundle of staple length fibers which is then transported to a coiler (not shown) for storage prior to spinning or other processing. Also omitted are guide or chute means to contain the staple fibers before entry into the trumpet 25 even though such guide or chute means may not be necessary, especially if the rollers of the, break draw frame BDF are positioned so that the staple fibers are travelling vertically downward at the point of discharge from draw rollers 11.

The entrance to trumpet 25 will typically be spaced from draw rollers 11 by a distance equal to about three to four of the desired staple lengths. The discharge end of trumpet 25 will typically be spaced from rollers 28 by a distance no more than about one such staple length. While the broken tow TB is shown in FIGS. 1 and 2 as being physically separated segments for purposes of illustration and discussion, it should be understood that the broken tow TB will, to the naked eye, appear more as a continuous tow as shown in FIG. 3.

Figure 2:
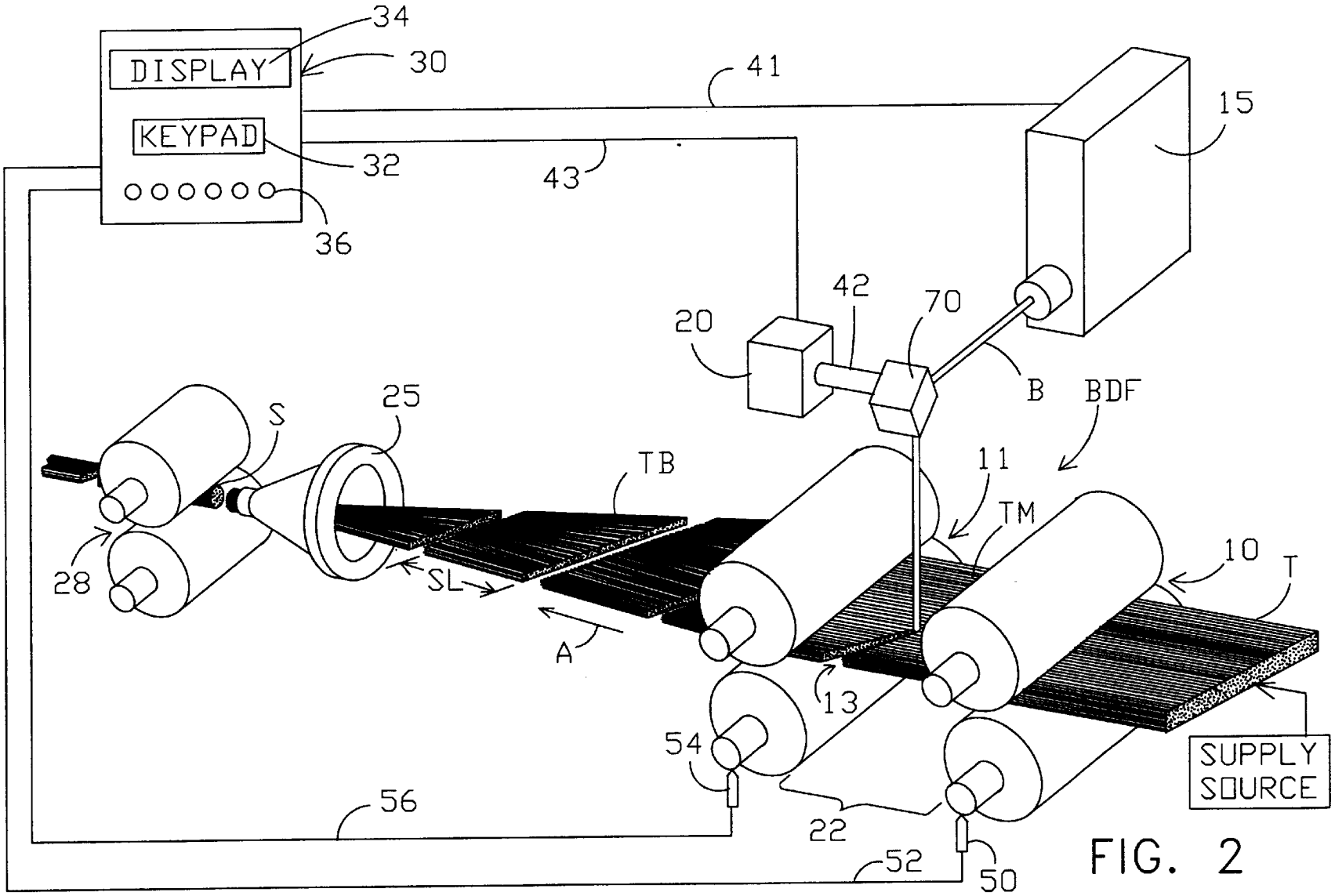
FIG. 2 illustrates the invention apparatus of FIG. 1 in an operative state according to a second embodiment similar to that of FIG. 1 but based on use of a multi-faced mirror.
Figure 3:
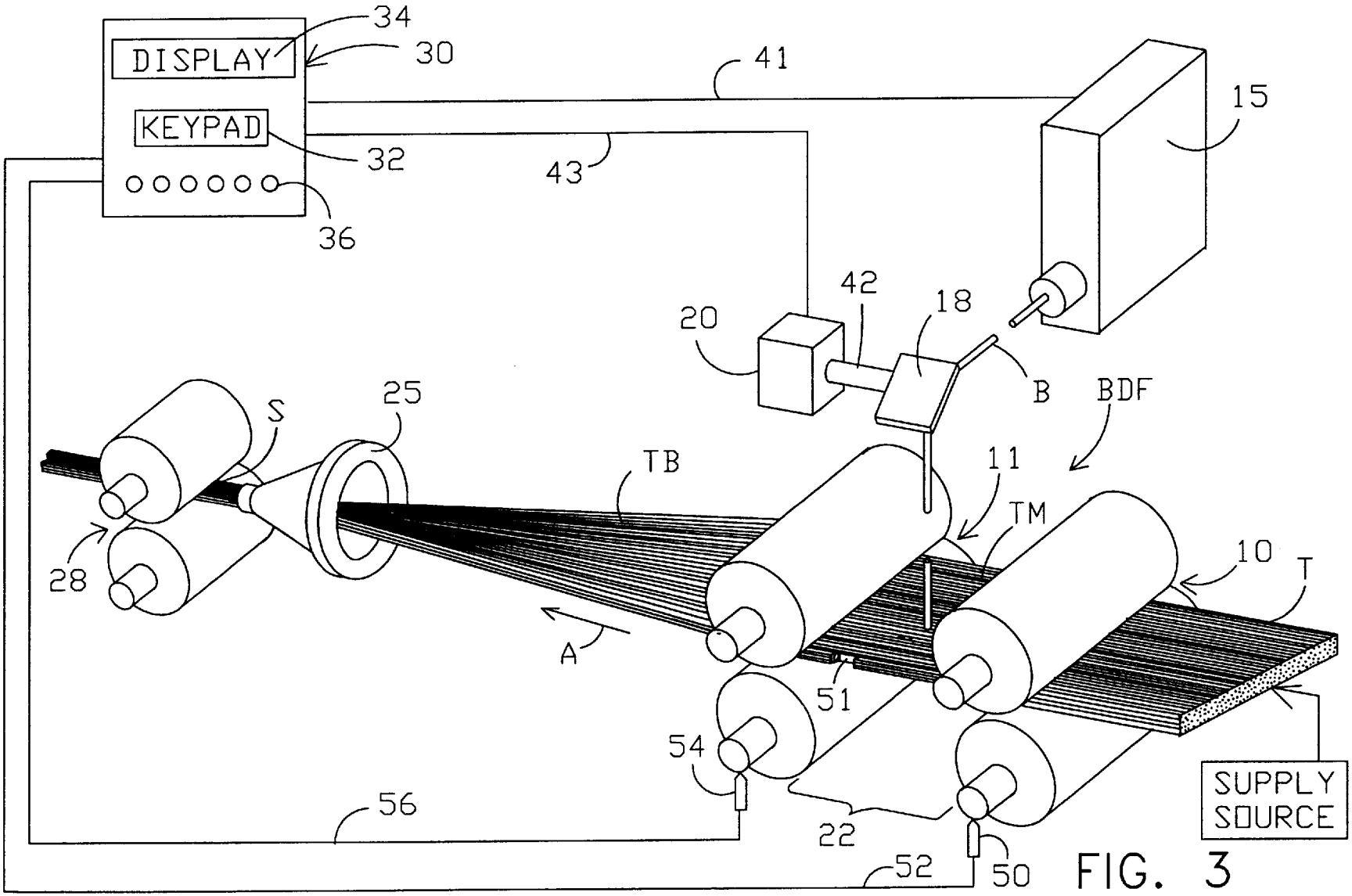
FIG. 3 illustrates a modification of the method of using the invention apparatus of FIGS. 1 according to a third embodiment.

In a second embodiment illustrated in FIG. 2, a four-sided mirror 70 replaces the single-sided mirror 18 of FIG. 1. In this embodiment, mirror 70 rotates constantly in one direction and laser 15 under the control of computer 30 is turned on and off in coordination with rotation of the four sides of the mirror. In other respects, the embodiment of FIG. 2 may be operated in the manner of either the method of FIG. 1 or of later described FIG. 3. The invention further contemplates that mirrors with an even greater number of reflecting surfaces might be employed.

It is contemplated, as previously mentioned, that two modes of operating the energy beam be employed depending on the characteristics of the synthetic fiber being processed. FIGS. 1 and 2 illustrate the first method in which the energy beam B is kept on through the full transverse sweep of beam B across the tow TM. This results in all the fibers in the tow being broken or effectively cut along a line, the angle of which is determined by the relative speed of the tow and the sweep of the energy beam. The transverse sweep is repeated at the beginning and end of each staple length. This method assures that all fibers in the tow are broken by the combined action of the mechanical stretch and the energy beam, but control of the broken ends of the fiber may be difficult with respect to certain kinds of synthetic fiber.

In the operating mode of the third embodiment illustrated in FIG. 3 and later described in more detail in reference to FIGS. 4–6, the energy beam B of the apparatus of FIG. 1 or FIG. 2 is pulsed on and off a number of times during each transverse sweep. The ratio of the length of on to off periods is set corresponding to the number of transverse sweeps made while the tow advances one staple length. For example, an on-off ratio of 1:4 would be used if four transverse sweeps are used per staple length. This mode in general results in better control of the fibers passing through the break draw zone particularly for certain types of synthetic fibers since each broken fiber will be adjacent to fibers which are not broken at the same point. It is necessary to control the timing of the on-off pulses of the energy beam so that different fibers will be broken on each sweep. Thus, when the control exercised by computer 30 causes the laser 15 to be off, the beam B is moved some predetermined transverse increment and this process is repeated after each "on" period of the laser 15 until the beam B is swept across the entire width of the tow TM. It is also necessary to maintain good lateral control of the fibers passing through the draw-zone 22 so that all the fibers, e.g. Fibers are broken once and only once as break 51. For each desired staple length as more fully later described in reference to FIGS. 4–6.

Also recognized, though not shown, is that with the possible future advent of light-weight high-powered lasers, the laser device itself could be precisely, position controlled and mounted such that its beam is directed onto the tow material and sweeping of the beam would be effected by precise movement of the laser device thus eliminating the need for the mirror.

Further recognized is an arrangement, not shown, in which relative motion between the tow material TM and the laser beam B could be achieved by shifting under precise control, the entire break drawframe BDF and maintaining the beam B in some predetermined fixed position. Thus, the embodiments shown in FIGS. 1–3 should be understood simply as being representative of ways to obtain relative motion between the tow material TM and the laser beam B.

While not shown, it is also contemplated that the invention apparatus and method could cause beam B to reciprocate back and forth across the tow. However it has been found most desirable to move beam B in the same direction on each sweep, when the laser 15 is operating.

In another aspect of the invention, while not shown, it is contemplated that several lasers and mirrors could be mounted side by side so as to be able to generate several laser beams and thereby effect several parallel cuts simultaneously.

The control system applicable to FIGS. 1–3 is similar and varies primarily in the way it is operated. A suitable programmed computer 30 having an appropriate keypad 32, display 34 and status light display 36 is connected through line 41 to control laser 15 which may, for example, be a 150 watt $CO_2$ type gas laser. Computer 30 is also connected through line 43 to drive motor positioner 20 which is suited to precisely position mirror 18 mounted on motor drive shaft 42 and to continually and precisely send a signal to computer 30 indicating the position of mirror 18 at any time. The speed of infeed rollers 10 is detected by a suitable speed sensor, schematically illustrated as sensor 50, connected to computer 30 through line 52. The speed of draw rollers 11 is detected by a suitable speed sensor 54 connected to computer 30 through line 56. Staple length can be adjusted simply by adjusting the roller speeds. Since lasers, computer controls, drive motors and speed sensors of the type required by the invention are well known, the same are not otherwise shown or described in detail. It should also be understood that the roller speeds and thus the tension asserted on the tow will vary with the desired staple length, the type of synthetic fiber, the number of sweeps per staple length and like factors. Based on accumulated experience, computer 30 is programmed such that upon entry of the staple length and type of tow in keypad 32, computer 30 will automatically determine the blade sweep rate, the roller speeds and similar factors all of which can be drawn from stored information. Computer 30 can also hold the settings from one run of tow to the next.

During startup, particularly on a new kind of fiber, experience with the apparatus and method of the invention indicates that it may be necessary to experience some waste until the settings for the particular fiber have been determined and the system has assumed a steady state and the desired staple length of fiber is obtained.

To complete the description, particularly in reference to the method and apparatus of FIG. 3, reference is next made to FIGS. 4, 5, and 6 which are intended to illustrate in a schematic way how use of the apparatus of FIG. 3 results not only in converting the continuous tow to staple fibers of uniform length but in a manner such that the cut ends of the fibers tend to be supported by adjacent uncut fibers. In this further explanation in reference to FIGS. 4–6, it must be understood that the invention can best be explained only in a schematic way since the tow T is typically only a few inches wide, e.g. six inches, and is typically relatively thin but nevertheless may comprise several hundred thousand individual filaments. The visual appearance to the naked eye of the incoming tow T in FIG. 3 will be very similar to the broken tow TB in FIG. 3 except for a somewhat fuzzy look and the appearance of cut ends, neither of which typically appear in the incoming tow T. Nevertheless, the broken tow TB of FIG. 3 will, to the naked eye, appear continuous as will the incoming tow T.

With continuing reference to FIGS. 4–6, FIG. 4 schematically represents a small section of the incoming tow T and assumes for purposes of discussion and reference that this small portion has been divided into twelve separate longitudinally extending subportions which are to be cut by beam B according to the method of using the FIG. 3 apparatus. These longitudinally extending subportions are numbered 1–12 for reference and it is further assumed for purposes of discussion that the beam B will make four sweeps for each staple length passing through the break draw frame BDF. Thus in FIG. 5, it is indicated that on sweep 1, subportions 1, 5 and 9 are cut at locations which are both laterally spaced from each other as well as being longitudinally shifted due to the travel of tow T; on sweep 2, subportions 2, 6 and 10 are cut in a similar manner at other locations; on sweep 3, subportions 3, 7 and 11 are cut in a similar manner at other locations; and on sweep 4 subportions 4, 8 and 12 are all cut in the same manner as previously explained and based on laser 15 being switched on and off during each sweep but with the on-off cycle being laterally advanced on each sequential sweep.

FIG. 6 shown in a schematic representation how the schematically designated subportions 1–12 of FIG. 4 might be considered as being rearranged by the intermittent operation method of the invention as illustrated in FIG. 3. In FIG. 6, it will be noted that each cut end CE of each staple length SL achieved by the invention resides adjacent and is supported by an uncut portion UE of an adjacent subportion, the overall result being a well controlled sliver. Also to be understood is that as each subportion is cut, the section of the subportion entering draw rollers 11 which itself may comprise several thousand individual filaments immediately pulls ahead and separates itself from the trailing section of the same subportion not engaged by rollers 11.

In summary, it can be seen that the method and apparatus of the invention in a broad sense provides a means through which synthetic fiber tow of indeterminate length passed through a break drawframe can be both tensioned by the break drawframe and selectively heated by a heat source moved relative to the tow to convert the tow to a sliver comprised of staple fibers of uniform length.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A method for converting fibers in the form of continuous synthetic fiber tow of indeterminate length into a sliver of spinnable staple length fibers comprising the steps:

(a) providing a break drawframe in which a continuous fiber tow of indeterminate length can be drawn and tensioned;

(b) establishing a supply of continuous fiber tow of indeterminate length;

(c) continuously feeding said continuous fiber tow of indeterminate length from said supply through said break drawframe and utilizing the break drawframe to tension the portion of tow passing therethrough;

(d) establishing a controllable concentrated source of energy adapted when energized and applied to the fibers comprising said tow to heat said fibers;

(e) energizing said concentrated source of energy and contacting that portion of said tow fed through said break drawframe with said energized concentrated source of energy according to a time sequence coordinated with travel of said tow through said break drawframe; and (f) moving said energized concentrated source of energy relative to said portion of tow according to said time sequence whereby to cause said source of energy to heat said portion of tow at selected longitudinally and laterally spaced locations thereon and assisted by the tension asserted by said drawframe on said portion of tow to cut said portion of tow at said locations and thereby convert the fibers in said portion of tow and each successive portion of said tow fed through said break drawframe into staple fibers of substantially uniform length.

2. The method according to claim 1 wherein the step of establishing said controllable concentrated source of energy comprises establishing a laser and controllable means for energizing said laser.

3. The method according to claim 1 wherein the step of contacting that portion of said tow passed through said break drawframe with said energized concentrated source of energy comprises reflecting a beam of said concentrated source of energy from its said source onto said portion of tow.

4. The method according to claim 1 wherein the step of moving said concentrated source of energy relative to said portion of tow comprises moving said concentrated source of energy transverse to the direction of motion of said portion of tow.

5. The method according to claim 1 wherein according to said time sequence said concentrated source of energy is energized only when in contact with said portion of tow.

6. The method according to claim 1 wherein according to said time sequence said concentrated source of energy is energized and deenergized during each of a predetermined number of sweeps over said portion of tow resulting in all the fibers of said portion of tow being broken.

7. The method according to claim 1 wherein the step of establishing said controllable concentrated source of energy comprises establishing a laser and controllable means for energizing said laser and including the step of selecting the said synthetic fiber tow to be of a type suited to being heated when contacted by said concentrated source of energy established by said laser.

8. An apparatus for converting fibers in the form of continuous synthetic fiber tow of indeterminate length into a sliver of spinnable staple length fibers comprising:

(a) means providing a continuous supply of said continuous tow of indeterminate length;

(b) a break drawframe in which said continuous fiber tow of indeterminate length can be drawn and tensioned;

(c) means for continuously feeding said tow of indeterminate length to said break drawframe;

(d) a controllable concentrated source of energy adapted when energized and applied to the fibers comprising said tow to heat the fibers;

(e) means to energize said concentrated source of energy and contact that portion of tow passing through said break drawframe with said energized source of energy according to a time sequence coordinated with travel of said tow through said break drawframe; and (f) means for moving said energized concentrated source of energy relative to said portion of tow according to said time sequence whereby to cause said source of energy to heat said portion of tow at selected longitudinally and laterally spaced locations thereon and assisted by the tension asserted by said drawframe on said portion of tow to cut said portion of tow at said locations and thereby convert the fibers in said portion of tow and each successive portion of said tow fed through said break drawframe into staple fibers of substantially uniform length.

9. The apparatus as claimed in claim 8 wherein said controllable concentrated source of energy comprises a controllable laser.

10. The apparatus as claimed in claim 8 wherein said concentrated source of energy creates a beam of said concentrated energy and further including controllable reflecting means to reflect said beam of concentrated energy onto said portion of tow.

11. The apparatus as claimed in claim 8 wherein said means for moving said energized concentrated source of energy relative to said portion of tow is able to move said concentrated source of energy transverse to the direction of motion of said portion of tow.

12. The apparatus as claimed in claim 8 including means to control said concentrated source of energy such that said concentrated source of energy is energized only when in contact with said portion of tow.

13. The apparatus as claimed in claim 8 wherein said concentrated source of energy is fixedly positioned.

* * * * *